United States Patent [19]

Oguri

[11] Patent Number: 4,942,835

[45] Date of Patent: Jul. 24, 1990

[54] OVERLOCK SEWING MACHINE WITH A LOOPER-THREAD GUIDE MECHANISM

[75] Inventor: Takashi Oguri, Mizunami, Japan

[73] Assignee: Brother Kogyo Kabushiki Kaisha, Japan

[21] Appl. No.: 357,885

[22] Filed: May 30, 1989

[30] Foreign Application Priority Data

May 31, 1988 [JP] Japan ..... 63-135192

[51] Int. Cl.[5] ..... D05B 1/20

[52] U.S. Cl. ..... 112/302; 112/166

[58] Field of Search ..... 112/162, 166, 302

[56] References Cited

U.S. PATENT DOCUMENTS

| | | | |
|---|---|---|---|
| 1,041,655 | 10/1912 | Merritt | 112/302 |
| 1,728,158 | 9/1929 | Becker | 112/302 |
| 2,778,329 | 1/1957 | Howell et al. . | |
| 3,221,688 | 12/1965 | Marforio | 112/162 |
| 3,333,560 | 8/1967 | Wiener et al. . | |
| 3,465,701 | 9/1969 | Walling . | |
| 4,356,782 | 11/1982 | Ueyama et al. . | |
| 4,373,460 | 2/1983 | Parker et al. . | |
| 4,466,371 | 8/1984 | Larsen | 112/302 |
| 4,649,841 | 3/1987 | Koshinaka . | |
| 4,690,080 | 9/1987 | Mikuni et al. . | |

FOREIGN PATENT DOCUMENTS 54-4162 1/1979 Japan .

*Primary Examiner*—Werner H. Schroeder
*Assistant Examiner*—David K. Suto
*Attorney, Agent, or Firm*—Oliff & Berridge

[57] ABSTRACT

An overlock sewing machine with a looper-thread guide mechanism of this invention is characterized by thread guide passages that are provided in the front face of the sewing machine body, and that go from thread tension disks toward loopers. By feeding looper thread along the thread guide passages, the looper thread is easily guided from a thread supply source, through the tension disks and a takeup, toward the loopers. Thus, the loopers can be threaded easily, quickly, and precisely.

7 Claims, 3 Drawing Sheets

OVERLOCK SEWING MACHINE WITH A LOOPER-THREAD GUIDE MECHANISM

BACKGROUND OF THE INVENTION

This invention relates to an overlock sewing machine with a looper-thread guide mechanism for guiding a looper-thread from a thread supply source into a looper.

A conventional overlock sewing machine with a looper-thread guide mechanism is proposed in Japan Published Unexamined Utility Model Application No. S54-4162. In the looper-thread guide mechanism, a looper thread from a thread supply source is fed through a thread tension stud located on the front face of the sewing machine, several thread guards, a thread takeup, and a looper-thread receiving eye. However, since this prior art has several thread guards, operators tend to thread the thread guards in a wrong order. An operator has to thread each of the thread guards and the takeup with a looper thread in the proper order, which is a tedious, intricate operation.

SUMMARY OF THE INVENTION

The object of this invention is to provide an overlock sewing machine with a looper-thread guide mechanism for threading a looper precisely and quickly.

This object is achieved by this invention, which provides an overlock sewing machine with a looper-thread guide mechanism, comprising: a vertically movable needle; a looper having a thread-receiving eye at its end for forming a chain stitch in cooperation with the needle; a thread-tension disk disposed at the front of a sewing machine body for maintaining tension in a looper thread; a takeup positioned between the looper and the thread tension disk (17) for taking up thread in synchrony with the sewing action of the looper; and a thread guide passage in the front face of the sewing machine body for guiding thread from the tension disk, through the movement area of the takeup, toward the looper.

BRIEF DESCRIPTION OF THE DRAWINGS

By way of example and to make the description clearer, reference is made to accompanying drawings in which.

DETAILED DESCRIPTION OF PREFERRED EMBODIMENTS

Figure 1:
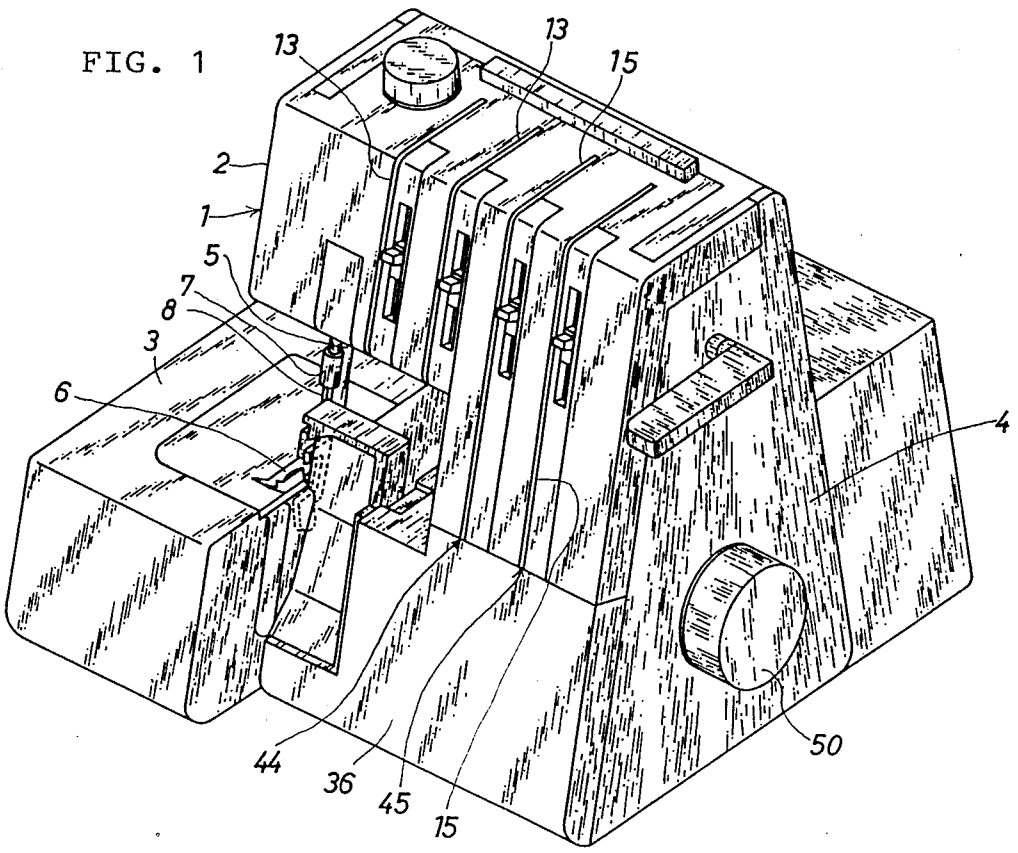
FIG. 1 is a perspective view of an overlock sewing machine embodying the present invention.
Figure 2:
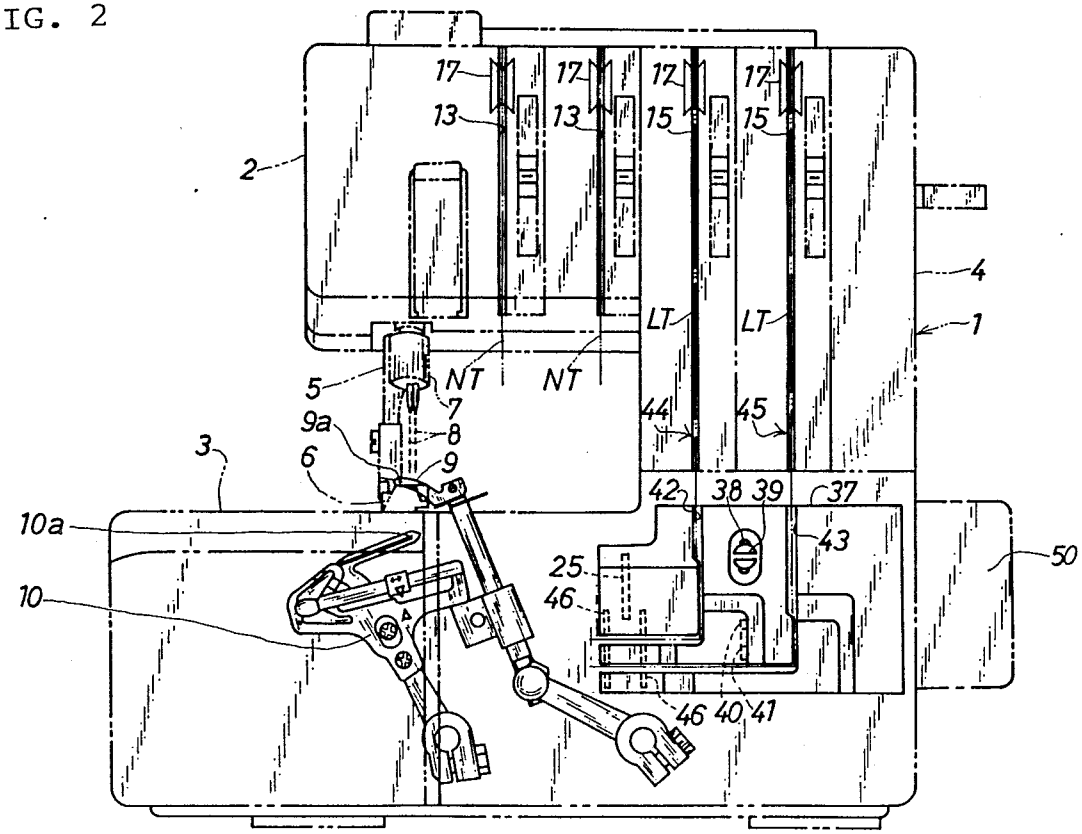
FIG. 2 is a partially sectional front view of the overlock sewing machine in FIG. 1.

As shown in FIGS. 1 and 2, a sewing machine body 1 comprises an arm 2, a bed 3, and a base 4. A presser foot 6 is attached through a presser bar 5 to the arm 2. Two vertically movable needles 8 are attached through a needle bar 7 to the arm 2. The bed 3 and the base 4 have an overlooper 9 and an under-looper 10 with thread-receiving eyes 9*a*and 10*a* in their respective tips. The loopers 9 and 10 sew a chain stitch on known fabric in cooperation with the needles 8.

Figure 3:
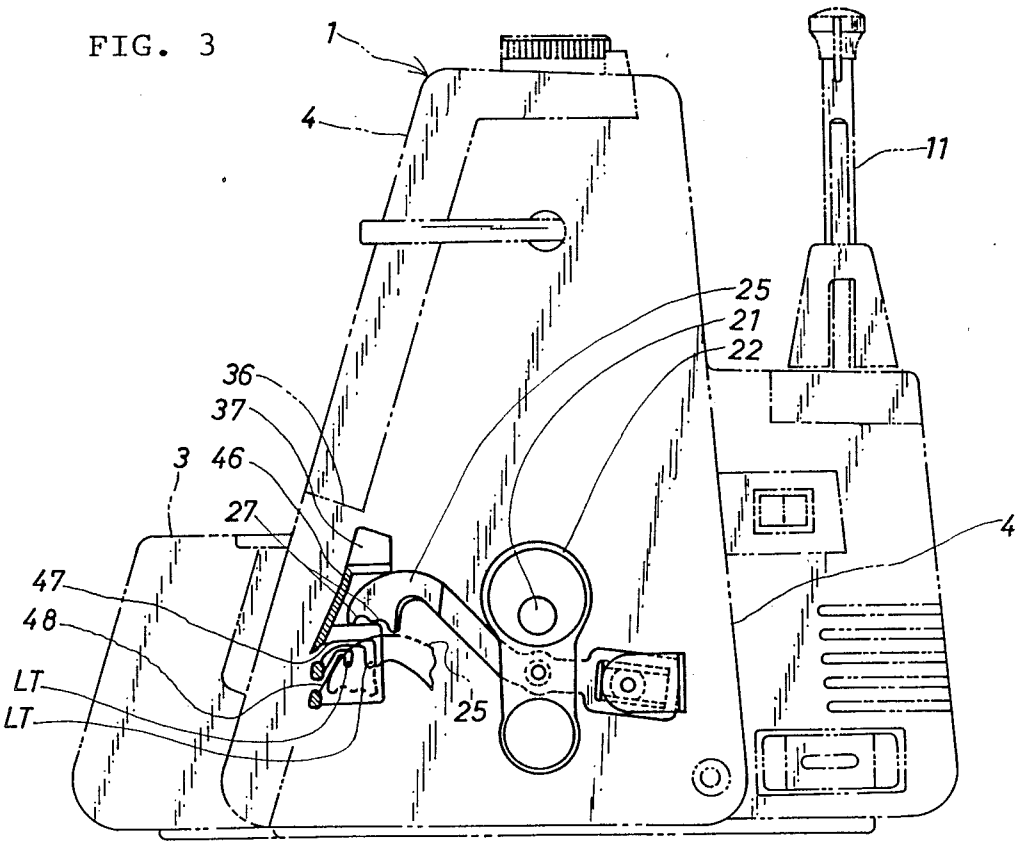
FIG. 3 is a sectional side view of the overlock sewing machine, showing the mechanism around a looper-thread takeup.

As shown in FIG. 3, several spool holders 11 stand on the rear end of the sewing machine body 1. Needle threads NT and looper threads LT are supplied from known bobbins through a known thread guide toward the front of the sewing machine body 1. A pair of left and right needle thread guide channels 13, running continuously from the top down toward the lower front face of the arm 2, guide the needle thread NT. A pair of left and right looper-thread guide channels 15, running continuously from the top down to the lower front part of the base 4, guide the looper thread LT.

Tension disks 17 are located in the needle-thread guide channels 13 and the looper-thread guide channels 15 at the upper front part of the sewing machine body 1, and maintain a predetermined tension in the needle threads NT and the looper threads LT.

As shown in FIG. 3, at the lower part of the base 4, a known sewing machine motor rotates a crank shaft 21 via a known sewing machine main shaft. A thread takeup 25 is driven vertically by the cooperating action of the crank shaft 21 and an eccentric portion 22 mounted on the crank shaft 21. On the front end of the takeup 25 are a pair of front and rear indentations 27 is in the front end of the takeup 25.

As shown in FIG. 1, the lower front face of the base 4 of the sewing machine body 1 is covered with an openable cover 36. As shown in FIG. 2, under the cover 36, a guide plate 37 is attached to a slide groove 38 through a screw 39. The vertical position of the guide plate 37 can be adjusted using the screw 39. A projection 40 on the rear face of the guide plate 37 engages with a slit 41 in the sewing machine body 1 so that the guide plate 37 is held in position.

In the guide plate 37, an over looper thread guide groove 42 and an under looper thread guide groove 43 extend continuously around L-shaped bends under the looper thread guide channels 15. The over looper thread guide groove 42, the under looper thread guide groove 43, and the looper thread guide channels 15 form thread guide passages 44 and 45, which extend from the tension disks 17 across the movement area of the takeup 25 through the loopers 9 and 10.

As shown in FIG. 3, a pair of thread guard plates 46 are fixed at the left and right sides of the movement area of the takeup 25 on the rear face of the guide plate 37. The thread takeup 25 moves between the thread guard plates 46. An upper threading channel 47 and a lower threading channel 48 are provided in the thread guard plates 46. The upper threading channel 47 connects with the over looper thread guide groove 42 and the lower threading channel 48 connects with the under looper thread guide groove 43. The vertically moving takeup 25 and the indentations 27 push down the looper threads LT, and maintain the tension necessary for the formation of the chain stitch.

In this overlock sewing machine, the needle threads NT and the looper threads LT from the bobbins pass through the known thread guides, the thread guide channels 13 and 15, and the tension disks 17. The cover 36 is opened, and the looper thread LT from the thread guide channels 15 is fed through the thread guide grooves 42 and 43. The looper threads LT are thus inserted into the thread tension disks 17, guided into the threading channels 47 and 48, and then positioned in the movement area of the takeup 25. The over looper thread guide groove 42 and the under looper thread guide groove 43 in the guide plate 37 extend toward the over looper 9 and the under looper 10, respectively. The thread-receiving eye 9*a*of the over looper 9 and the thread-receiving eye 10*a* of the under looper 10 can be easily threaded. Consequently, by threading just the thread guide passages 44 and 45, the looper threads LT can be easily and precisely guided through the loopers 9 and 10.

On the other hand, the needle threads NT are guided from the left and right needle-thread guide channels 13 through the eyes in the needles 8.

As shown by a broken line in FIG. 3, the thread takeup 25 is in its lowest position during threading. When the crank shaft 21 is rotated at least once with a manual pulley 50, the takeup 25 rises, and the looper threads LT are positioned in the movement area of the takeup 25 due to the tension of the looper threads LT.

When the thread takeup amount of the takeup 25 is altered according to the thickness of fabric, the vertical position of the guide plate 37 is adjusted using the screw 39 to change the height of the thread guard plates 46. Thus, the takeup amount can be easily adjusted.

It should be understood that, although one specific embodiment of the invention has been shown and described for the purpose of illustration, the invention is not limited to the embodiment illustrated and described, but that in its broadest aspects it includes all equivalent embodiments and modifications that come within the scope of the claims.

What is claimed is:

1. An overlock sewing machine with a looper-thread guide mechanism, comprising:

a vertically moveable needle;

an over looper and an under looper, each having a thread-receiving eye at its end for forming a chain stitch in cooperation with the needle;

an over looper thread tension disk and an under looper thread tension disk, each disposed at a front of a sewing machine body for maintaining tension in each looper thread;

a takeup positioned between the loopers and the thread tension disks for taking up threads in synchrony with a sewing action of the loopers; and thread guide means in the front of said sewing machine body having an over looper thread guide groove and an under looper thread guide groove, each thread guide groove being L shaped to guide each thread from each tension disk, through a movement area of the takeup, toward each looper.

2. An overlock sewing machine according to claim 1, in which the thread guide means is movably attached to the sewing machine body, thus altering a thread takeup amount of the takeup.

3. An overlock sewing machine according to claim 1, in which the over looper thread guide groove extends toward the over looper and the under looper thread guide groove extends toward the under looper.

4. An overlock sewing machine according to claim 3, in which a pair of thread guard plates are fixed at the left and right sides of the movement area of the takeup behind the thread guide means and are fixed to the back of the thread guide means, the thread takeup of movable between the thread guard plates, an upper threading channel and a lower threading channel are provided in the thread guard plates, the upper threading channel connects with the over looper thread guide groove, and the lower threading channel connects with the under looper thread guide groove.

5. An overlock sewing machine according to claim 4, in which the thread guide means is slidably attached to the sewing machine body, thus altering a thread takeup amount of the takeup by changing a height of the thread guide plates.

6. An overlock sewing machine according to claim 1, in which a sewing machine motor rotates a crank shaft via a sewing machine main shaft, an eccentric portion is mounted on the crank shaft, the takeup is driven vertically by the vertical motion of the eccentric portion, and a pair of front and rear indentations are formed at a front end of the takeup.

7. An overlock sewing machine according to claim 6, in which the eccentric portion drives the takeup which is vertically moving and the pair of the indentations so as to push down the looper thread, and to maintain the tension required for the information of the chain stitch.

* * * * *